US010751606B1

(12) United States Patent
Harris et al.

(10) Patent No.: US 10,751,606 B1
(45) Date of Patent: Aug. 25, 2020

(54) GARMENT GAMING APPARATUS

(71) Applicants: Javish Harris, Lindenwold, NJ (US); Benjamin Jones, Albany, GA (US)

(72) Inventors: Javish Harris, Lindenwold, NJ (US); Benjamin Jones, Albany, GA (US)

( * ) Notice: Subject to any disclaimer, the term of this patent is extended or adjusted under 35 U.S.C. 154(b) by 0 days.

(21) Appl. No.: 16/296,634

(22) Filed: Mar. 8, 2019

(51) Int. Cl.
*A63F 11/00* (2006.01)
*A41B 1/08* (2006.01)

(52) U.S. Cl.
CPC ..... *A63F 11/0011* (2013.01); *A41B 1/08* (2013.01); *A63F 2011/0016* (2013.01); *A63F 2250/166* (2013.01)

(58) Field of Classification Search
CPC ..... A63F 11/0011; A63F 2250/166; A63F 2011/0016; A41B 1/08
See application file for complete search history.

(56) References Cited

U.S. PATENT DOCUMENTS 2,224,996 A * 12/1940 Walsh ..... A63F 5/04 273/141 R
2,719,718 A * 10/1955 Rothgery ..... A63F 5/04 273/142 JB
4,200,290 A * 4/1980 Csoka ..... A63F 11/0011 273/139
4,211,414 A * 7/1980 Moodt ..... A63F 5/04 273/141 A
4,723,323 A 2/1988 Wright, Jr.
4,963,208 A 10/1990 Muncy et al.
5,222,259 A 6/1993 Bristor
6,782,554 B1 8/2004 Froehlich
7,082,622 B1 * 8/2006 Olander ..... A41F 9/002 2/336
7,765,618 B2 10/2010 Egglesfield
D806,990 S 1/2018 Dixon
9,877,527 B1 1/2018 Marshall
2011/0217897 A1 9/2011 Sackley
2015/0096108 A1 4/2015 Almeda, Jr.

* cited by examiner

*Primary Examiner* — Jeffrey S Vanderveen
(74) *Attorney, Agent, or Firm* — The Law Firm of Andrea Hence Evans LLC

(57) ABSTRACT

A gaming apparatus that comprises a garment, an anchor member, a bearing device and a spinner. The anchor member can be coupled to the garment mechanically or using an adhesive. The anchor member can include a base portion and a neck portion. The base portion can include a magnet. The bearing device can be mechanically coupled to the anchor member. The bearing device is configured to rotate with respect to an axis of rotation passing through the anchor member the bearing device. The spinner is mechanically coupled to the bearing device.

15 Claims, 9 Drawing Sheets

GARMENT GAMING APPARATUS

TECHNICAL FIELD

Some implementations relate generally to gaming apparatus coupled to a piece of fabric or garment.

BACKGROUND

In the case of fashion, there are fairly limited options that incorporate aspects of gaming with garments and other wearable articles. In many cases, these garments only possess the functionality of being able to be worn. Accordingly, there exists a need for an apparatus that can integrate aspects of gaming with wearable garments.

SUMMARY

Some or all of the above needs and/or problems may be addressed by certain embodiments of the disclosure. Certain embodiments of the disclosure can include a gaming apparatus coupled to a fabric or garment. An embodiment of the gaming apparatus can include a garment, an anchor member, a bearing device and a spinner. The anchor member can be coupled to the garment mechanically or using an adhesive. The anchor member can include a base portion and a neck portion. Further, the base portion can include a magnet. The bearing device can be mechanically coupled to the anchor member. The bearing device is configured to rotate with respect to an axis of rotation passing through the anchor member the bearing device. The spinner is mechanically coupled to the bearing device.

A method for utilizing the gaming apparatus can include rotating a spinner with respect to an anchor member that is coupled to the garment. The method can also include identifying an activity based on the location of the spinner with respect to the plurality of sections, upon the ended rotation of the spinner element. The method can further include completing the task as that is indicated by the spinner.

Other embodiments, features, and aspects of the disclosure are described in detail herein and are considered a part of the claimed disclosure. Other embodiments, features, and aspects can be understood with reference to the following detailed description, accompanying drawings and claims.

DETAILED DESCRIPTION

Figure 1:
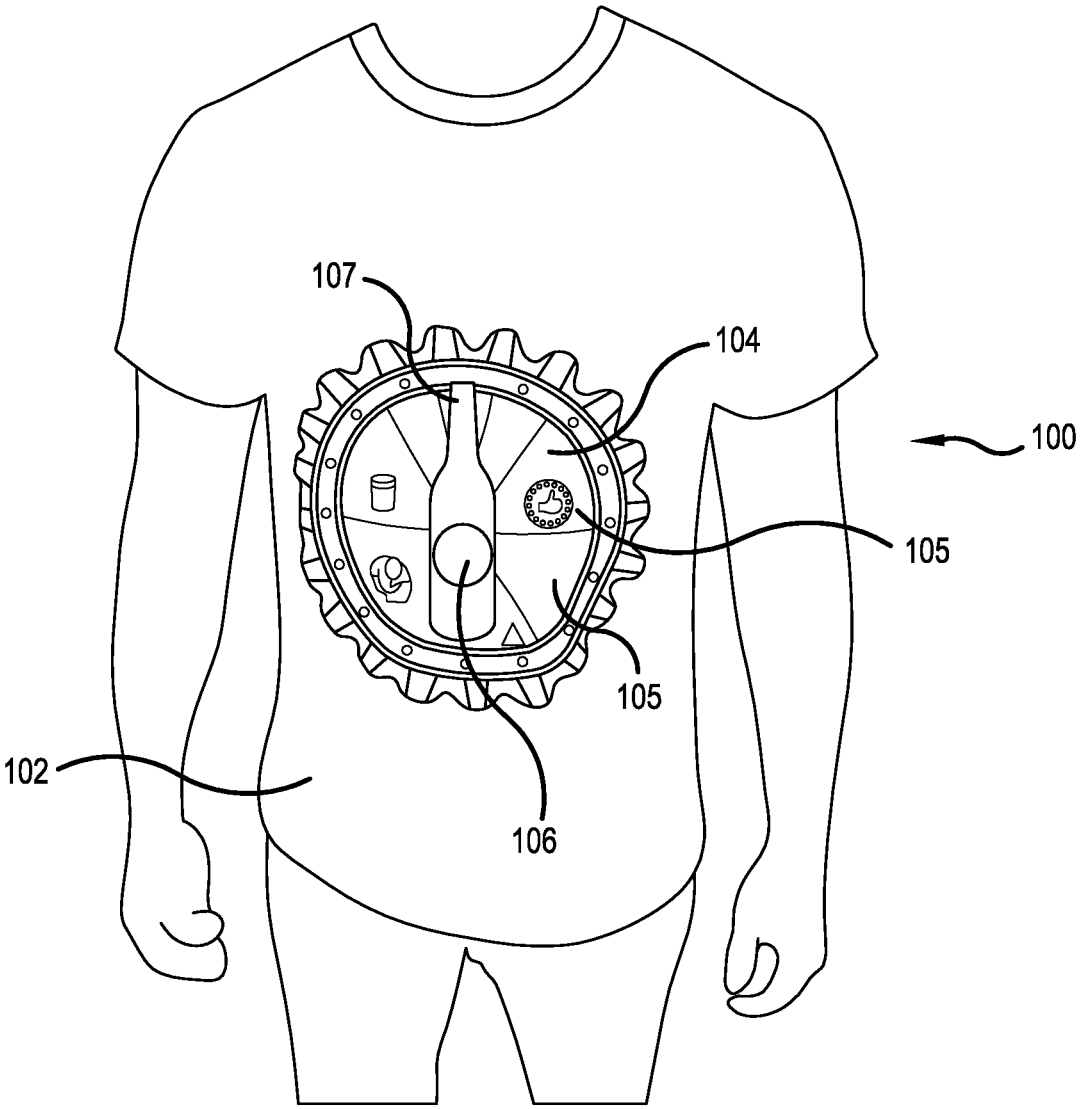
FIG. 1 is a diagram of a front view of the gaming apparatus of the disclosure.

Illustrative embodiments of the disclosure will now be described more fully hereinafter with reference to the accompanying drawings, in which some, but not all embodiments of the disclosure are shown. The disclosure may be embodied in many different forms and should not be construed as limited to the embodiments set forth herein; rather, these embodiments are provided so that this disclosure will satisfy applicable legal requirements.

Whenever appropriate, terms used in the singular also will include the plural and vice versa. The use of "a" herein means "one or more" unless stated otherwise or where the use of "one or more" is clearly inappropriate. The use of "or" means "and/or" unless stated otherwise. The use of "comprise," "comprises," "comprising," "include," "includes," and "including" are interchangeable and not intended to be limiting. The term "such as" also is not intended to be limiting. For example, the term "including" shall mean "including, but not limited to."

The following description is provided as an enabling teaching of the disclosed articles, systems, and methods in their best, currently known embodiments. To this end, those skilled in the relevant art will recognize and appreciate that many changes can be made to the various aspects of the articles, systems, and methods described herein, while still obtaining the beneficial results of the disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "a gasket" can include two or more such gaskets unless the context indicates otherwise.

As used throughout, "substantially" with respect to a measure can refer to a range of values comprising +/−10 degrees. For example, substantially orthogonal, normal, or parallel can include embodiments, where the referenced components are oriented +/−10 degrees of being classified as orthogonal, normal or parallel respectively.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

Figure 2:
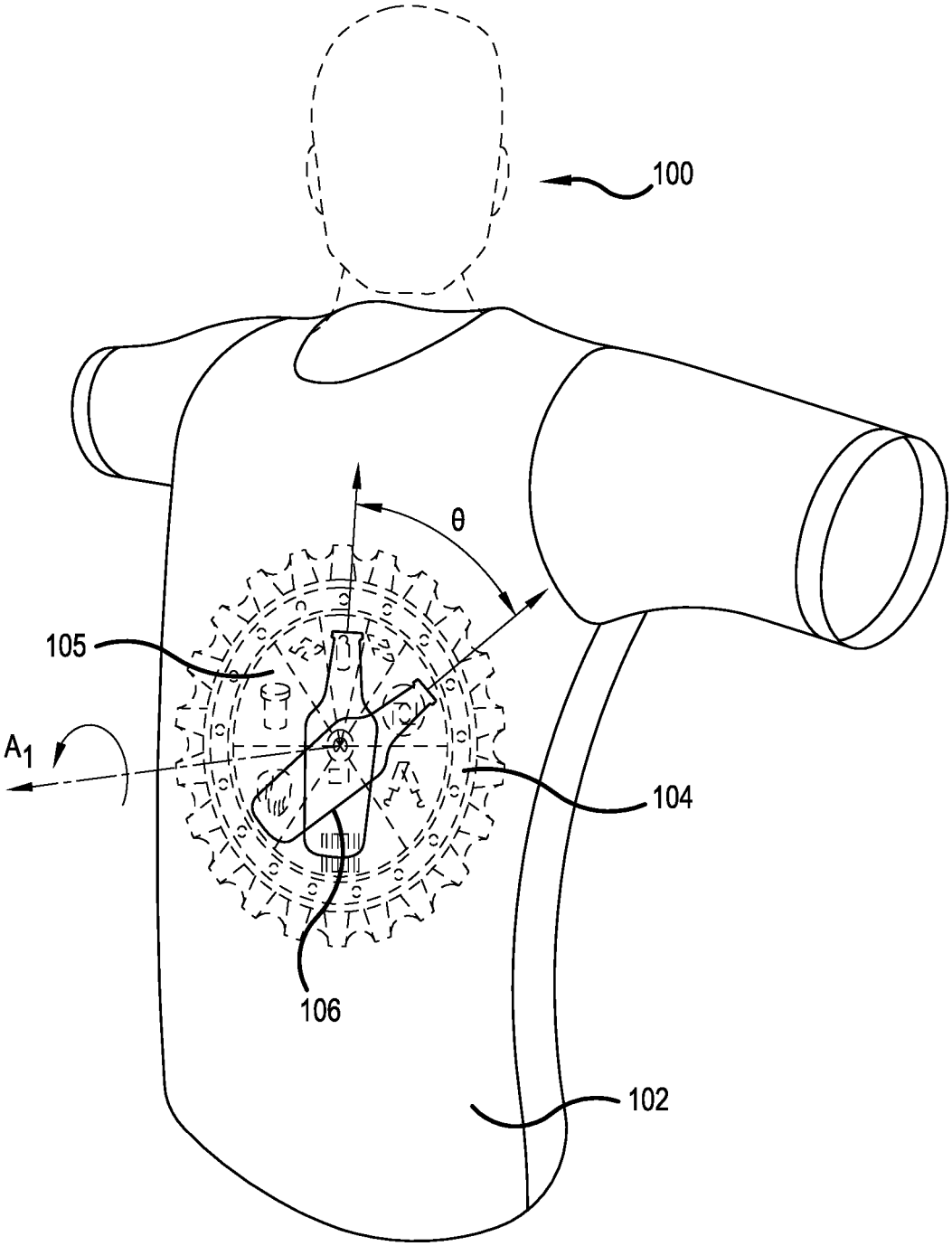
FIG. 2 is a diagram of an isometric view of the gaming apparatus in FIG. 1.
Figure 3:
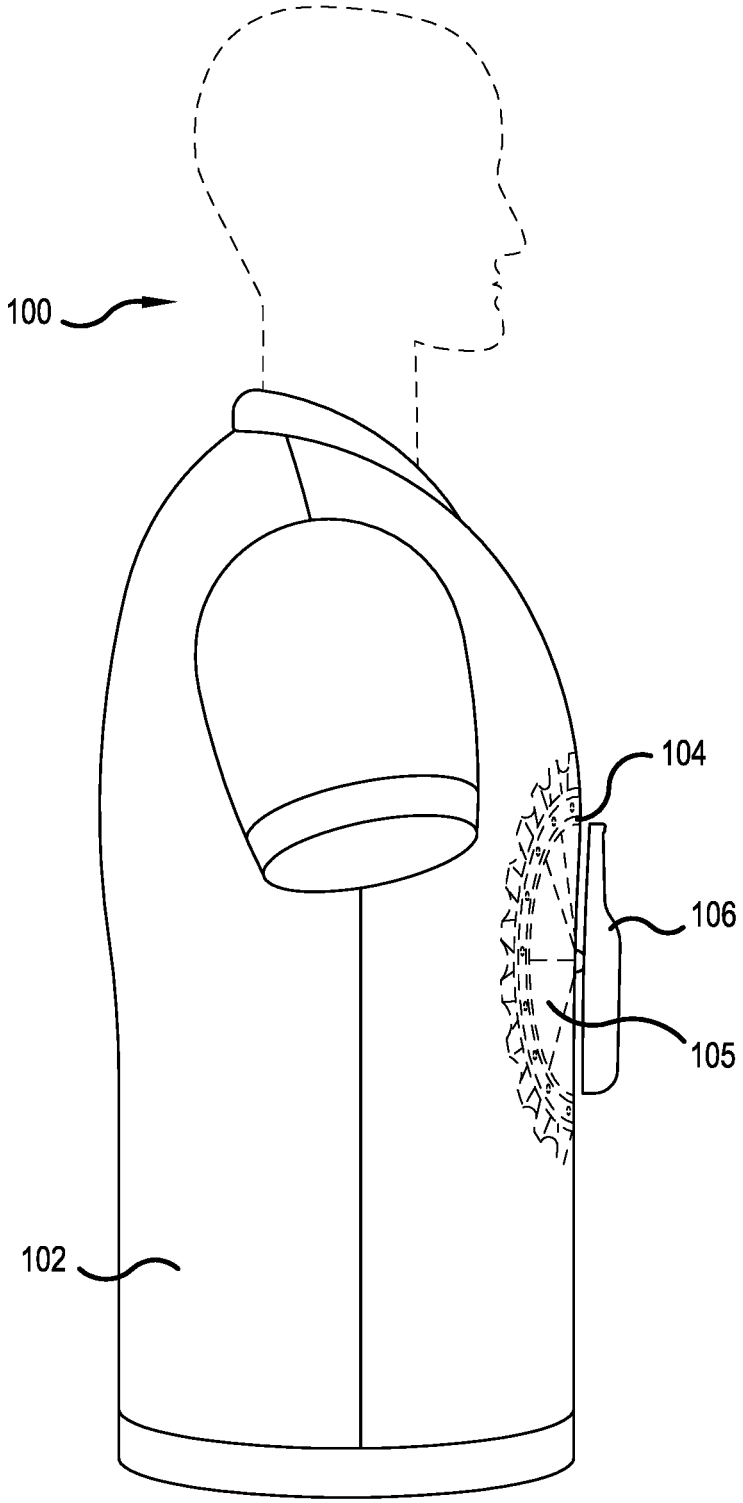
FIG. 3 is a diagram of a side view of the gaming apparatus in FIG. 1.

FIGS. 1 through 3 depict an embodiment of the disclosure. The gaming apparatus 100 can include a garment such as a shirt 102, an indicia 104 and a spinner 106. When using the gaming apparatus 100, a user can manually turn the spinner 106. When the spinner 106 stops rotating a distal portion 107 of the spinner can point to a section 105 on the indicia of the shirt 102. The indicia can include words, symbols or text, for example.

In a further aspect of the disclosure, the garment 102 can be any garment wearable by a user. For example, the garment 102 can be a sweatshirt, jacket, shawl, blanket, pants or even a pair of shoes. In another aspect of the garment 102, the garment can be a hat. In yet another aspect of the environment the garment 102 can also be a satchel, a purse, a backpack, a fanny pack, or other element that can be worn by a person or pet, such as a doggie sweater.

The garment 102 can further comprise an indicia, 104, on the surface of the garment 102. As shown in FIGS. 1-3, the indicia 104 can comprise a circular display but the display can be any known shape. In a further aspect, the circular display can be split into multiple sections 105. These multiple sections 105 can include graphical designs or words indicating an activity that must be performed for that particular section. For example, if the indicia 104 comprises activities for a drinking game then each particular subsection 105 of the circular display defines separate activity that is to be performed when the spinner 106 comes rests on a particular section. In another aspect, the indicia 104 can be other geometric shapes. For example the indicia 104 can be a square shape wherein each subsection 105 is split into separate subsections 105. The subsections 105, act as a divider between the indicia 104 to ensure it is clear where the spinner's distal portion 107 is positioned on or pointed to. It is further considered that a plurality of other geometric shapes can be used. In yet other aspects, the indicia 104 can be the shape of animals, faces or other designs by the design maker.

Figure 4:
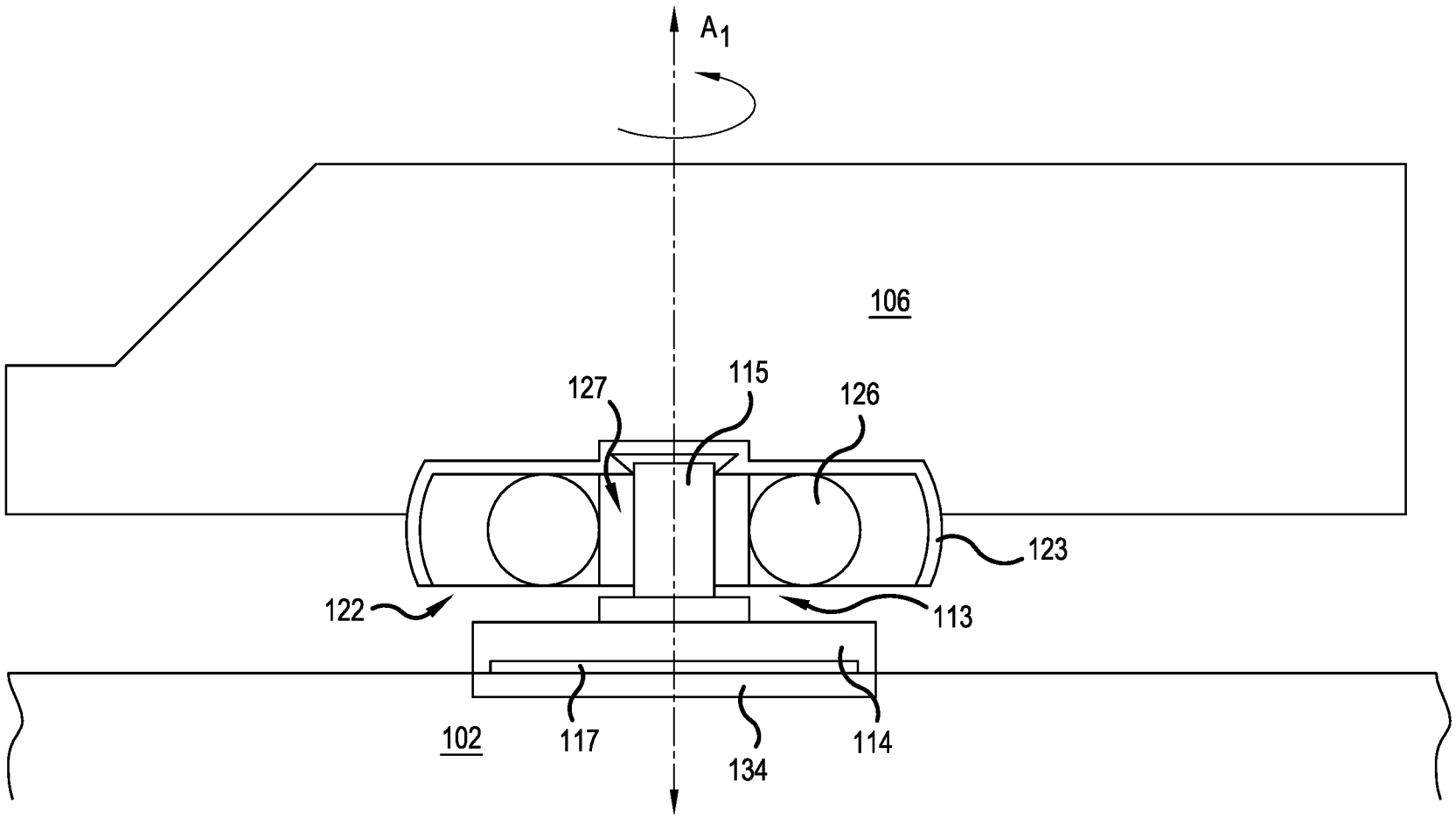
FIG. 4 is a cross-sectional side view of the diagram depicted in FIG. 3.
Figure 5A:
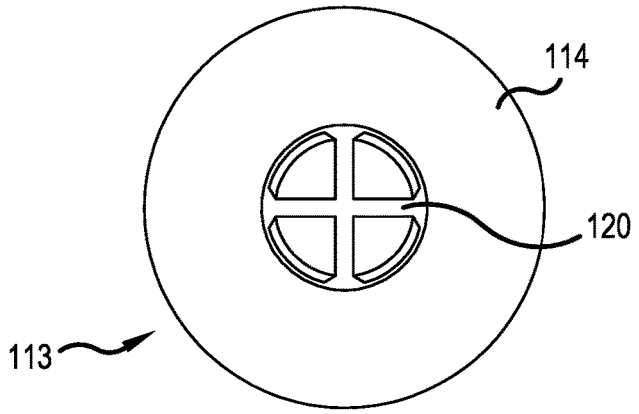
FIG. 5A is diagram of the top view of the anchor member; 5B is a side view of the anchor member; 5C is a bottom view of the anchor member; and 5D is a perspective view of the anchor member.
Figure 5B:
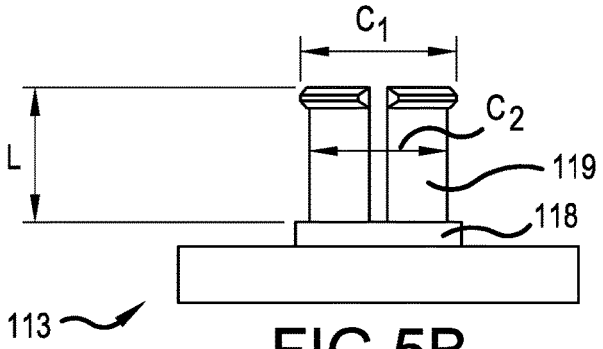
Figure 5D:
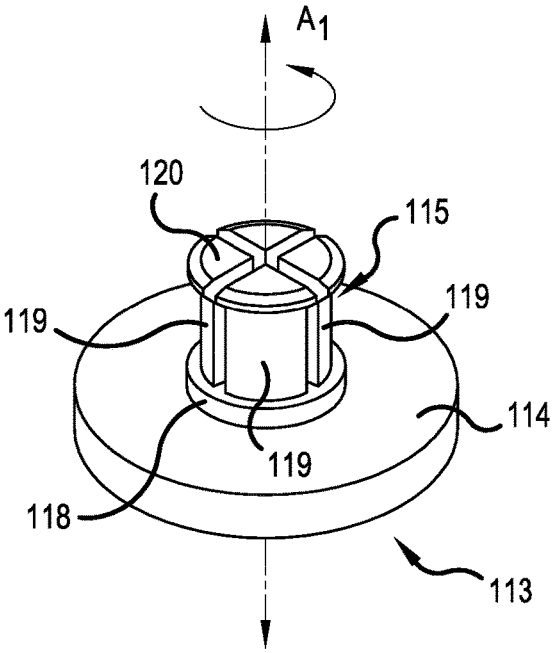
Figure 5C:
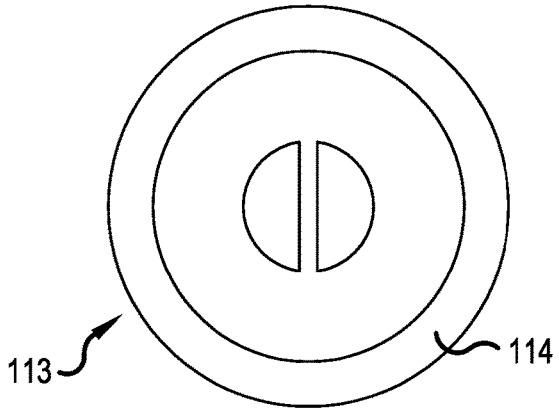
Figure 7:
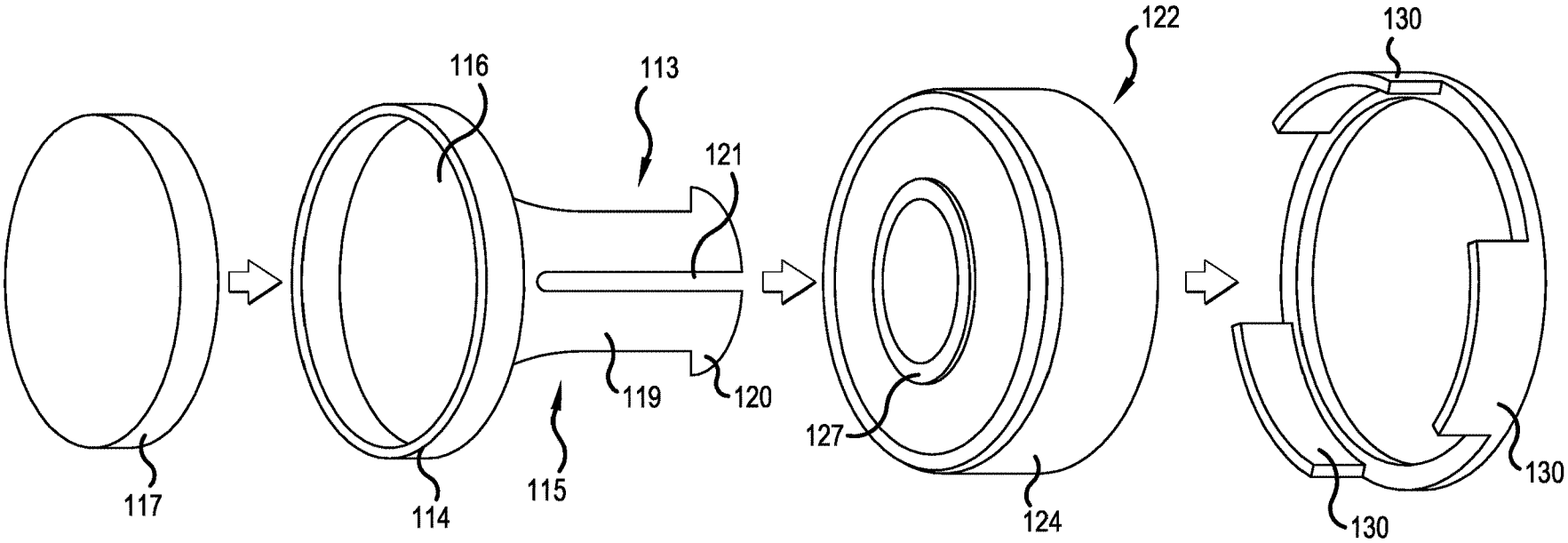
FIG. 7 is a diagram of an exploded view of the anchor member, the bearing device and the bracket.
Figure 8A:
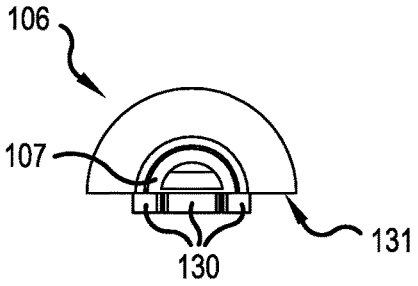
FIG. 8A is diagram of the top view of the spinner 8B is a side view of the spinner; 8C is a rear view of the spinner; 8D is a bottom view of the spinner; and 8E is a perspective view of the spinner.
Figure 8B:
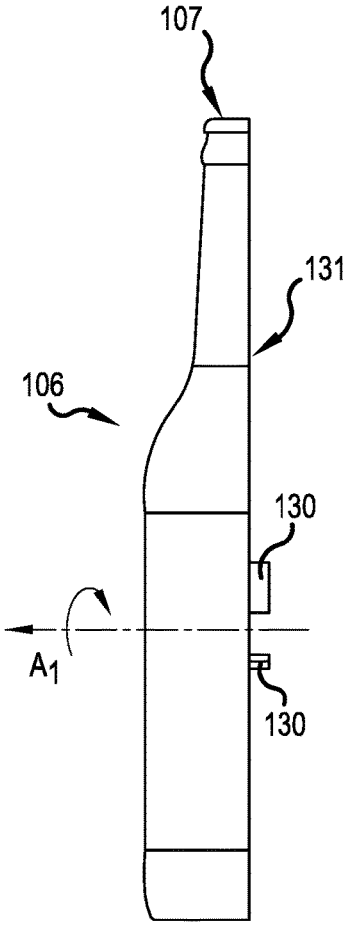
Figure 8C:
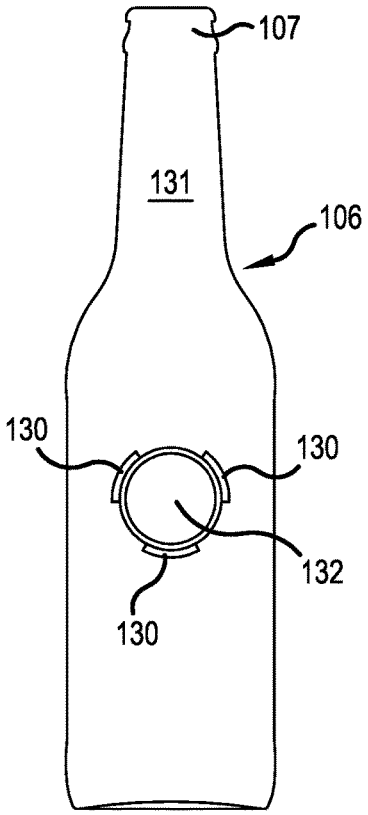
Figure 8E:
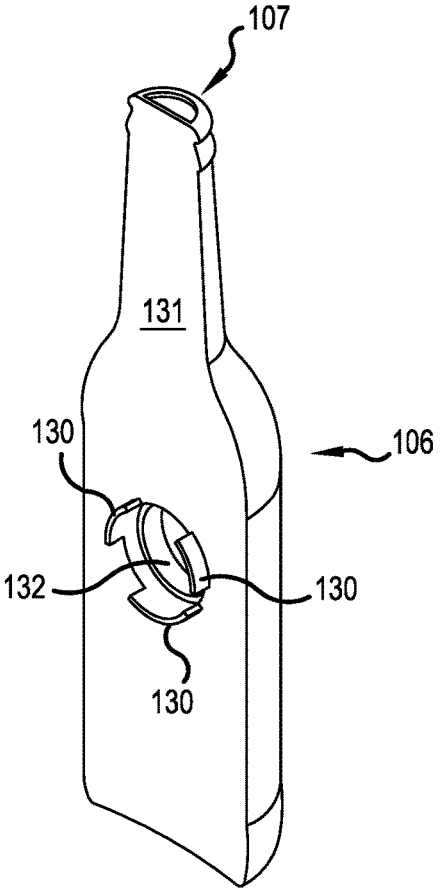
Figure 8D:
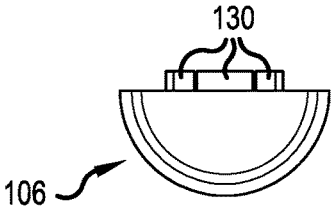

As shown in FIG. 4, the garment 102 can also further comprise of a metal plate 134 under the garment 102, on the opposite side of the surface of the shirt where the indicia 104 is. The plate 134 is attached to the magnet 117 through magnetism. As shown in FIG. 7, the magnet 117 is positioned or nested inside of the cavity 116 of the base member 114. The plate 134 is on the underside of the garment 102 and is attracted to the magnet 117 on the top side of the garment 102, as shown in FIG. 4. The metal plate 134 stabilizes the spinner 106 and can give it a flat surface for even spinning around the axis A1. The magnetic pull by the magnet 117 on the metal bearing balls 126 during rotation alters the rotational speed of the spinner, causing the spinner 106 to stop sooner and indicate or identify a respective section 105 of the indicia on the garment 102.

As shown in FIGS. 5A-5D, the gaming apparatus comprises an anchor member 113. In an aspect of the disclosure, the anchor member 113 is used to couple the spinner 106 to the garment 102. The anchor member 113 can be coupled to the shirt 102 using a fastener or an adhesive. For example, the anchor member can be coupled to the garment 102 using fasteners including but not limited to snaps, rivets, hook and loops, buttons or the like. In a further aspect, the adhesive used couple the anchor member can be of sufficient strength to maintain a connection with the shirt and counteract the moment forces placed on the shirt by the rotating spinner 106.

The anchor member 113 can comprise a plurality of components. In one aspect, the anchor member 113 can comprise a base portion 114 and a neck portion 115. In a further aspect, the base portion 114 can be comprised of a cylindrical shape. In other embodiments, the base portion 114 comprises a prism shape, such as a cube, rectangular prism or other geometric prism. The base portion 114 can also define a cavity 116 at the external surface in proximity to the garment 102. Within the cavity 116, a magnet 117 can be placed by adhesive or mechanically coupling to the base portion 114. In another embodiment, the magnet 117 can coupled on a top surface of the base portion 114, diametrically opposite the surface facing the garment 102. In yet another embodiment, the base portion can be magnetized in the absence of a magnet 117. In yet another option embodiment, the magnet 117 can circumscribe the base portion 114. In each of the previous orientations, the magnet placement will have an impact on the rotation of a bearing device 125. The magnet 117 attracts to the plate 134 to aid in securing the gaming apparatus to the garment.

The anchor member 113 can also comprise a neck portion 115. In a further aspect, the neck portion 115 can comprise a bottom region 118, a middle region 119, and a top region 120. The bottom region 118 of the neck portion 115 can be coupled to a top surface of the base portion 114. The neck portion 115 can extend distally away from the base portion 114. The neck portion 115 can extend through a middle region 119 and terminate at a top region 120. In a further aspect, the neck portion 114 can have a cylindrical shape as shown in FIGS. 5A, 5B, 5C and 5D. In a further aspect, the top region 120 can have an external circumference C1 that is greater that the external circumference C2 of the middle region 119.

To aid in the full coupling of the gaming apparatus 100, the neck portion 115 can define a channel 121. The channel 121 in one aspect can span the length L of neck portion 115 and in other aspects the channel 121 can span a portion of the length L. In yet another aspect, the neck portion 115 can have a plurality of channels 121. In such a configuration, the plurality of channels 121 can be oriented such that the channels are orthogonal to each other. However, additional orientations of channels exist. The channels 121 in the neck portion 115 can serve the purpose of allowing the neck portion 115 to have some pliability when the anchor member 113 is coupled to the bearing device 122. To minimize wobbling during rotation, spatial clearance between the outer surface of the middle region 119 of the anchor member 113 and the surfaces of in the interior ring 127 of the bearing device 122 can also be minimized. To facilitate coupling of the channeled neck portion allows the circumference C1 of the top region 120 to be reduced. Accordingly, the top region 120 can fit through the interior ring 127 of the bearing device during construction of the gaming apparatus 100. Further, the greater dimension C1 of the top region 120 than the dimension C2 of middle region 119 also can serve the purpose of creating a locking mechanism between the anchor 113 and the bearing device 122.

Figure 6:
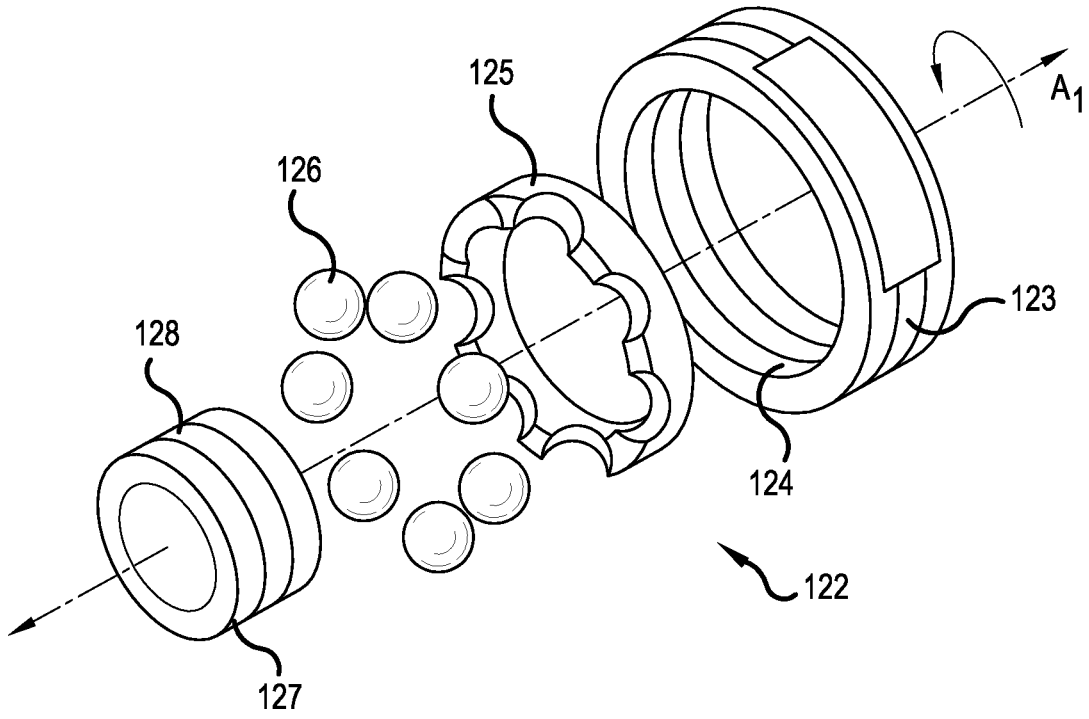
FIG. 6 is a diagram of an exploded view of the bearing device in the gaming apparatus.

As shown in FIGS. 6 and 7, the gaming apparatus can further comprise a bearing device 122. The bearing device 122 enables rotation of the spinner, while reducing friction and handling stress. The bearing device 122 can comprise an exterior ring 123, a retainer 125, a plurality of balls 126 and the interior ring 127. During construction of the bearing device 122, in one aspect balls 126 can be mechanically coupled to connect with the retainer 125. The retainer 125 features a cutout portion sized to received the balls 126. The retainer 125 can ensure that the balls 126 rotate uniformly around the axis A1. The balls 126 can further be coupled to contact an outer surface of the interior ring 127. In a further aspect, to for further facilitate the uniform rotation, the outer surface of the inner ring 127 can comprise an inner groove 128. In a further aspect, an inner surface of the exterior ring 123 can also be in contact with the bearings 122. Further, the inner surface of the exterior ring 123 can also define a groove 124, allowing the balls 126 to contact the inner surface as well as have a path of uniform rotation around the axis A1. In a further aspect, components of the bearing device 122 can be magnetized. Magnetization of the bearings will allow the magnetic field of the magnet 117 located in proximity to the anchor 113 to impact the rotation of the bearing device 122. For example, the balls 126 may be magnetized or made of a metallic material, while the additional components including the exterior ring 123, the interior ring 127 and the retainer 125 are non-magnetized or are made out of non-metallic materials. A plurality of combinations are possible regarding the material composition of the bearing device 122 to facilitate interaction or non-interaction with the magnet 117.

As shown in FIGS. 8A-8E, gaming apparatus 100 can comprise a spinner 106. The spinner can be mechanically coupled to the bearing device 122. In a further aspect, the bearing device 122 can be connected by a plurality of flanges 130 on the external surface 131 of the spinner 106. In another aspect, the spinner 106, can further comprise an external surface 131. The external surface can define a cavity 132 wherein the cavity is of sufficient size to circumscribe the mechanically coupled anchor 113 and bearing device 122 shown in FIG. 7. The flanges 130 are positioned around the perimeter of the cavity 132. The spinner 106 can be coupled to the bearing device 122 using the flanges 130 that extend from the surface 131, wherein the flanges 130 can lock onto an external surface of external ring 123. The flanges 130 locking onto the external surface of the bearing device causes the spinner 106 to rotate at substantially the same angular speed as the exterior ring of the bearing device 122. In, the coupled configuration, as shown in FIGS. 1-4, the spinner 106 and the bearing device 122 can rotate around the axis A1.

The spinner can comprise a plurality of shapes. In one aspect is shown in FIGS. 1-3 and 8A-E, the spinner can comprise the general shape of a bottle, wherein the shape of the bottle is consistent with the indicia 104 identifying aspects of a drinking game. It is further considered that the spinner 106 can also comprise different shapes, for example an arrow, vegetable, or even some type of animal shape. In yet another aspect, the spinner 106 can have a weight distribution that is uniformly distributed as it rotates around the axis A1. The uniform distribution of weight can allow the spinner 106 to spin freely and uniformly. In another, aspect the spinner 106 can have a weight distribution that is asymmetrical. For example, the asymmetrical weight distribution can allow the spinner head 107 to be constantly pointing north when the spinner 106 is at rest.

The spinner can comprise a polymer, plastic, silicone or metallic material. They can comprise magnetized plastic, such that the weight of the spinner 106 is not increased dramatically. In another aspect, the spinner 106 can be hollow, while in another aspect the spinner can be solid. In yet another aspect the spinner 106 is filled with a material such as a liquid or a plurality of solid materials for such as beads, wherein the addition of these materials can also impact the rotation speed and subsequent stopping point of the spinner.

Figure 9:
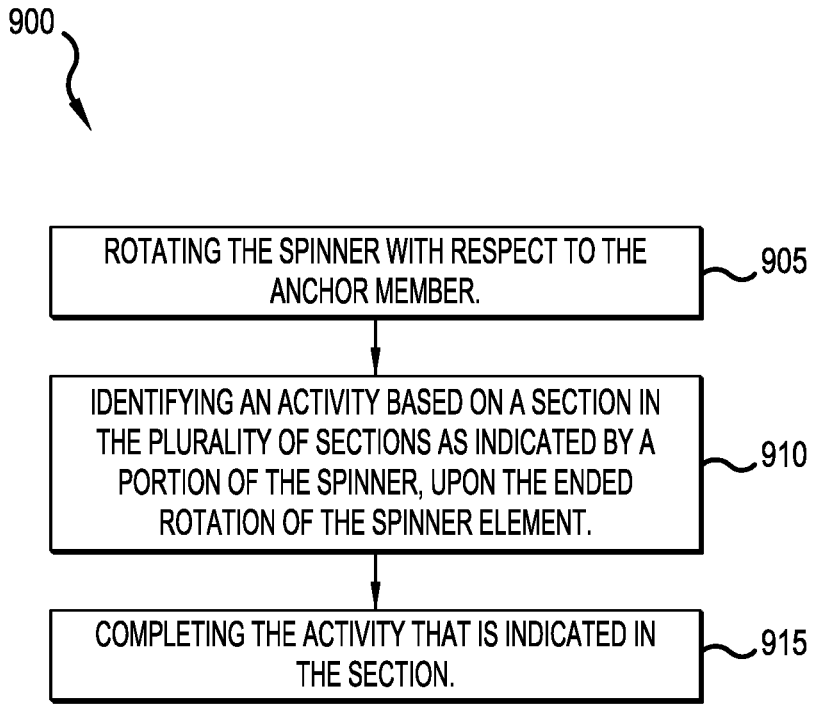
FIG. 9 is a block diagram displaying a method for utilizing the gaming apparatus of the disclosure.

FIG. 9 is a flowchart representing an example method for utilizing the gaming apparatus. The example method 900 can be implemented by the gaming apparatus. The operations described and shown in the method 900 of FIG. 9 may be carried out or performed in any suitable order as desired in various embodiments of the disclosure. Additionally, in certain embodiments, at least a portion of the operations may be carried out in parallel. Furthermore, in certain embodiments, less than or more than the operations described in FIG. 9 may be performed. The method 900, according to an example embodiment of the disclosure, can include rotating a spinner with respect to an anchor member that is coupled to the garment. Block 910 can include identifying an activity based on the location of the spinner with respect to a section of the indicia, upon the ended rotation of the spinner. Block 915 can include, completing the task or activity that is detailed in the section of the indicia. In other aspects of block 915, a user may decide not to complete the indicated task, wherein the user may rotate the spinner again with the anticipation of a different activity being identified.

While certain embodiments of the disclosure have been described in connection with what is presently considered to be the most practical and various embodiments, it is to be understood that the disclosure is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosure, including the best modes, and also to enable any person skilled in the art to practice certain embodiments of the disclosure, including making and using any devices or systems and performing any incorporated methods. The patentable scope of certain embodiments of the disclosure is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gaming apparatus comprising:

a garment;

an anchor member coupled to the garment, comprising a base portion and a neck portion, wherein the base portion comprises a magnet;

a bearing device mechanically coupled to the anchor member, wherein the bearing device is configured to rotate with respect to an axis of rotation passing through the anchor member the bearing device; and a spinner that is mechanically coupled to the bearing device;

wherein the bearing device further comprises an exterior ring, an interior ring, a plurality of bearings and a bearing retainer, wherein the interior ring and exterior ring are configured to rotate independently around the axis of rotation by mechanically coupling the plurality of bearings into the retainer, connecting the plurality of bearings to an outer surface of the interior ring and connecting the plurality of bearings to an inner surface of the exterior ring;

wherein the bearings are magnetized.

2. The spinner of claim 1 wherein the spinner further comprises a mounting bracket, wherein the mounting bracket is configured to be mechanically coupled to an external surface of the bearing device.

3. The spinner of claim 1 wherein the spinner is symmetrically weighted with respect to the axis of rotation.

4. The spinner of claim 1 wherein the spinner is asymmetrically weighted with respect to the axis of rotation.

5. The anchor member of claim 1, wherein the base portion defines a cavity wherein the magnet is configured to be placed.

6. The bearing device of claim 1, comprising: an exterior ring, an interior ring, a plurality of bearings and a bearing retainer, wherein the interior ring and exterior ring are configured to rotate independently around the axis of rotation by mechanically coupling the plurality of bearings into the retainer, connecting the plurality of bearings to an outer surface of the interior ring and connecting the plurality of bearings to an inner surface of the exterior ring.

7. The bearing device of claim 6, wherein the bearings are magnetized.

8. The anchor member of claim 1, wherein the neck portion comprises a bottom region coupled to the base portion of the anchor member and top region extending distally away from the bottom region, wherein the top region defines at least one channel.

9. The anchor member of claim 8 wherein, the at least one channel spans a dimension between the top region and the bottom region of the neck portion.

10. The anchor member of claim 1, wherein the neck portion further comprises a middle region located between the top region and bottom region wherein an external dimension of the top region is greater than the external dimension of the middle region.

11. The spinner of claim 1 wherein an external surface of the indication defines a cavity where in the cavity is dimensioned to encapsulate the bearing device and anchor member.

12. The spinner of claim 1 wherein at least portion of the spinner is magnetized.

13. The garment of claim 1 wherein the garment comprises an indicia located in proximity to the coupled anchor member.

14. The indicia of claim 13, wherein the indicia comprises a plurality of sections such that each section in the plurality of sections are identifiable by a distal portion of the spinner.

15. A method of utilizing a gaming apparatus comprising a garment comprising an indicia that comprises plurality of sections: an anchor member coupled to the garment, comprising a base portion and a neck portion, wherein the base portion comprises a magnet; a bearing device mechanically coupled to the anchor member; and an spinner that is mechanically coupled to the bearing device, by:

rotating the spinner with respect to the anchor member;

upon the ended rotation of the spinner element, identifying an activity based on a section in the plurality of section as indicated by a portion of the spinner; and completing the activity that is indicated in the section;

wherein the bearing device further comprises an exterior ring, an interior ring, a plurality of bearings and a bearing retainer, wherein the interior ring and exterior ring are configured to rotate independently around the axis of rotation by mechanically coupling the plurality of bearings into the retainer, connecting the plurality of bearings to an outer surface of the interior ring and connecting the plurality of bearings to an inner surface of the exterior ring;

wherein the bearings are magnetized.

* * * * *